United States Patent [19]

Massey et al.

[11] Patent Number: 4,469,280

[45] Date of Patent: Sep. 4, 1984

[54] METHOD FOR HEATING AGGLOMERATING SLURRIES

[75] Inventors: Lester G. Massey, Moreland Hills, Ohio; Robert I. Brabets, Lombard, Ill.; David A. George, Park Forest, Ill.; William A. Abel, Joliet, Ill.

[73] Assignee: CNG Research Company, Cleveland, Ohio

[21] Appl. No.: 394,695

[22] Filed: Jul. 2, 1982

Related U.S. Application Data

[62] Division of Ser. No. 127,736, Mar. 6, 1980, Pat. No. 4,369,351.

[51] Int. Cl.[3] ..... B02C 19/12

[52] U.S. Cl. ..... 241/1; 241/17; 241/21; 241/23

[58] Field of Search ..... 241/1, 301, 17, 21, 241/23; 219/284, 291, 292, 300, 293

[56] References Cited

U.S. PATENT DOCUMENTS

| | | | |
|---|---|---|---|
| 2,560,807 | 7/1951 | Lobo | 241/1 |
| 2,662,007 | 12/1953 | Dickinson | 241/1 X |
| 3,352,498 | 11/1967 | Schulte | 241/1 |

*Primary Examiner*—Mark Rosenbaum

*Attorney, Agent, or Firm*—Allegretti, Newitt, Witcoff & McAndrews, Ltd.

[57] ABSTRACT

A method for heating agglomerating slurries in association with a method and apparatus for heating such slurries to supercritical conditions by electrical resistance. A feed slurry and a dilution stream are passed in admixture to a heating zone, and heated. A portion of the heated admixture is separated to provide the dilution stream, which is substantially free of agglomerating solids, to lower agglomeration in the heating zone. Preferably, the solid particles of the dilution stream are comminuted between separation of the dilution stream and before admixture with the feed slurry.

7 Claims, 12 Drawing Figures

PHASE DIAGRAM
PURE SUBSTANCE 70
74
72

1Ø,AC
75
76
74
5.
77
72
5.
70
78
SLURRY EXIT 85
3Ø
86
7.
82
89
SLURRY EXIT
88
84
7.
86
80
81
HEATER BODY
BUNDLE POSITION PIN (CERAMIC)
ELECTRODE (ST. STL.)
MOUNT. BOLT (ST. STL.)
ELECTRODE POSITIONING RING
86
94
81
92
90
93
82
80
91
84

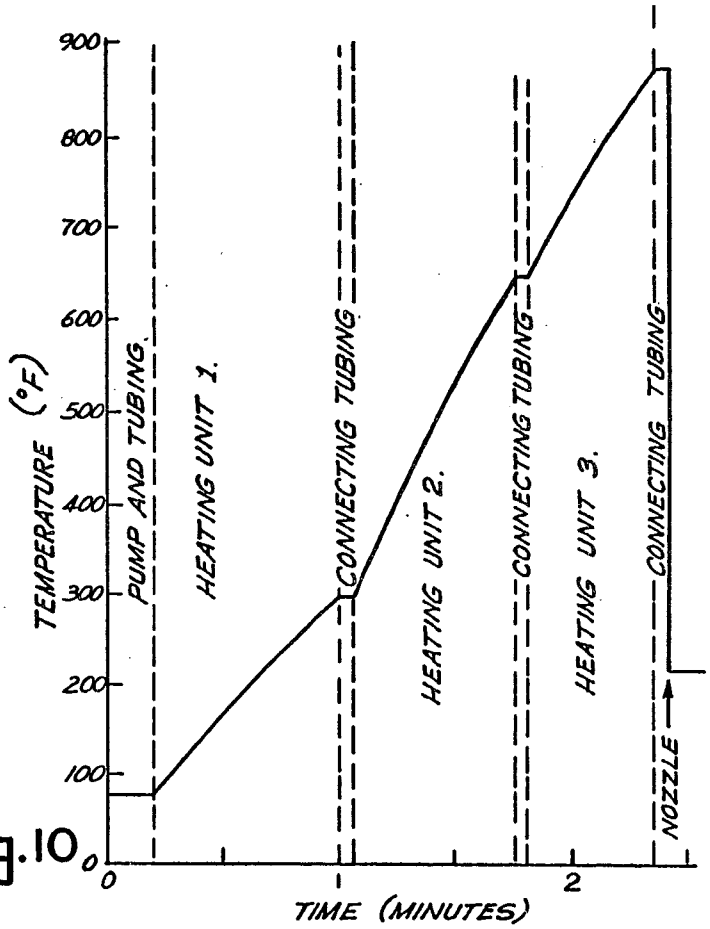
Fig. 10
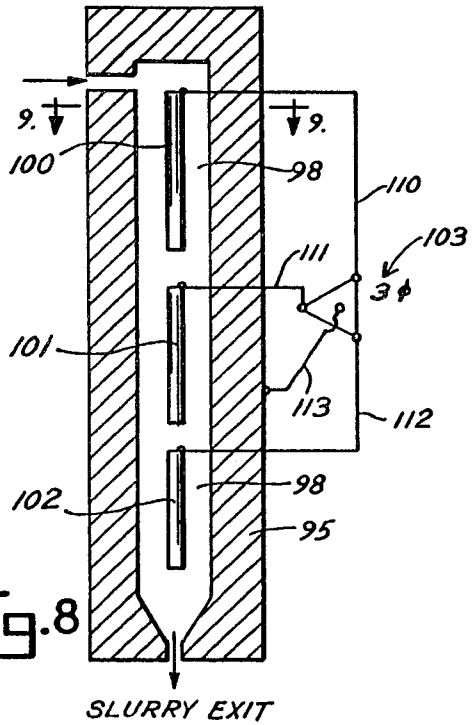
Fig. 9
Fig. 8

METHOD FOR HEATING AGGLOMERATING SLURRIES

This is a divisional of application Ser. No. 127,736, filed Mar. 6, 1980, now U.S. Pat. No. 4,369,351 issued Jan. 18, 1983.

BACKGROUND OF THE INVENTION

This invention relates to an improved method for heating fluids. More particularly, this invention relates to a method for heating liquids and agglomerating slurries, preferably above their critical points. The invention also relates to a novel method for controlling the rate of heating of a liquid or slurry.

"Critical point" and the "supercritical region" can be best illustrated by reference to FIG. 1 attached hereto. At ambient temperatures and pressures the vapor and liquid phases of a pure normally liquid substance, such as water, can be distinguished clearly from one another. For example, at a temperature, t, a liquid phase can be produced by applying a pressure, p, which exceeds the vapor-liquid boundary curve, labeled "saturation line". At temperatures equal to and higher than $t_c$ a liquid phase cannot be produced regardless of the pressure applied to the vapor. At the critical point, $t=t_c$ and $p=p_c$, and the vapor and liquid phases are in fact indistinguishable. When both the temperature and pressure exceed the critical point, the substance is in a "supercritical condition" and is called a "supercritical fluid". At this point only a single phase exists which cannot be defined as either liquid or vapor.

A liquid can be vaporized by passing electricity directly through the liquid, thus using the electrical resistance of the liquid as the heating element of an electric circuit. Conventional home vaporizers operate on this principle. Ott de Lorenzi in *Combustion Engineering-A Reference Book In Fuel Burning and Steam Generation* (1st ed. 1949 Combustion Engineering Superheater, Inc.) Ch. 17, pp. 17-1 through 17-10, teaches a commercial adaptation of such an apparatus.

The de Lorenzi teaching limits the application of this technique to temperatures and pressures below about 400° F. and about 250 pounds per square inch absolute ("psia"). In addition, de Lorenzi controls the rate of heating by adjusting the water level in the heater. Finally, de Lorenzi teaches that the electrodes in a single unit heater having multiple electrodes must be insulated from each other by an insulating plate to maintain voltage balance.

It is also known that electrically conductive liquids continue to exhibit some conductivity in the supercritical region. See, for example, Marshall, *Conductances and Equilibria of Aqueous Electrolytes Over Extreme Ranges of Temperature And Pressure,* 18 Rev. Pure and Appl. Chem. 167 (1968) and the references cited therein. These fluids, however, experience a dramatic drop in conductivity as they pass through the critical point. For example, Quist and Marshall, *Electrical Conductances of Aqueous Sodium Chloride Solutions From* 0 *To* 800° *And At Pressures To* 4000 *Bars,* 72 J of Phy. Chem. 684 (February 1968), FIG. 4, page 689, show that the specific conductance of a 0.001 molal sodium chloride solution drops from about 70 ($ohm^{-1}$ $cm^{-1}$) $X10^{-5}$ to less than about 5 ($ohms^{-1}$ $cm^{-1}$) $X10^{-5}$, a factor of 1400%, as the temperature of the solution is raised from below critical to above critical temperature (specifically from 578° F. (303° C.) to about 768° F. (409° C.)) while the pressure is held at about critical pressure (about 3200 psia (217 bars)). Thus, the prior art teaching indicates that direct resistance heating cannot practically be used to heat a fluid beyond its critical point.

Heating slurries that agglomerate presents additional difficulties. For example, conventional heating techniques for heating liquids and slurries generally involve direct firing or transferring of heat from a hotter material to a cooler material, by a shell-and-tube type heat exchanger. When these conventional indirect techniques are used for heating agglomerating slurries, such as a slurry of coal and water, to supercritical temperature, agglomeration of the coal on the heating surface can result. The agglomerated coal can then clog the system and impede efficient operation and heat transfer. In addition, the heat transfer provided by these conventional techniques is relatively slow. As a result, the equipment often includes lengthy heat exchange tubing, making the apparatus inappropriate for applications with small space and rapid heating requirements.

The present invention is designed to improve upon these and other aspects of the prior art.

SUMMARY OF THE INVENTION

Accordingly, it is an object of this invention to provide a method for heating a fluid to and beyond its critical temperature, particularly when the pressure imposed on the fluid exceeds its critical pressure.

Another object of this invention is to provide a method for producing a supercritical fluid.

A further object of this invention is to provide a method for rapidly heating a fluid stream.

A still further object of the present invention is to provide a heating method which can be easily and safely controlled with high energy efficiency.

It is a specific object of the present invention to provide a method to heat an agglomerating slurry, such as a slurry of coal and water, to temperatures in excess of the critical temperature of the slurry fluid while the fluid pressure is maintained above the critical pressure.

In a broad embodiment therefore, the subject matter of this invention relates to a method for heating an electrically conductive fluid to a supercritical temperature. The method involves passing an electrical current directly through a fluid, utilizing the electrical resistance of the fluid as the heating element. In another principal aspect, the invention relates to a method for controlling the rate of heating of a fluid by adjusting the electrical conductivity and, thus the resistance of the fluid.

The present invention preferably employs an apparatus for heating a fluid to supercritical conditions. The apparatus includes a heating chamber having an interior surface that is electrically conductive. At least one conductor or electrode, adapted to be connected to a source of electricity, is positioned within the chamber. The liquid or slurry is passed through the chamber as electrical current is simultaneously passed from the conductor, through the fluid and to the interior surface of the chamber. The electrical current is converted to heat energy by the fluid's electrical resistance. In other words, the fluid functions as an electrical resistance heater in an electric circuit.

An electrolyte is preferably added to the fluid in order to regulate the conductivity of the fluid, reduce agglomeration and to permit efficient heating up to and beyond 500° F. Moreover, by properly designing the heating unit, the rate of heating can be easily controlled by increasing or decreasing the addition of electrolyte to the fluid being heated, thus avoiding complex electrical switching apparatus. Temperature control at supercritical temperatures can also be obtained by varying the pressure on the system.

A specific embodiment of the heating apparatus can provide over 1,000,000 BTU/hr/ft$^2$ of heat transfer per unit of electrode surface and over 5.4 million BTU/hr/ft$^3$ per unit of available reactor volume. Even higher heating rates can be obtained by increasing the electrical current passed through the fluid.

This rapid, high temperature method of heating is accomplished without any contact between the fluid and a heating surface. These factors render the present invention particularly well suited for heating agglomerating slurries, such as coal and water. Moreover, this invention provides unusually high heating efficiencies, e.g. on the order of 99%.

In another embodiment, the present invention comprises a method for heating a slurry of solids which normally have a tendency to agglomerate upon exposure to elevated temperatures, while substantially reducing, if not eliminating the tendency of these solids to agglomerate. In this embodiment, the slurry solids are passed to a heating zone in admixture with a specifically defined dilution stream. This dilution stream is characterized as having a solids content less than the solids content of the original slurry. Preferably, the dilution stream is substantially free of solid materials. After mixing of the solids and the dilution stream, the resultant diluted mixture is then heated to an elevated temperature to provide a heated, diluted slurry. At least a portion of the slurry fluid is then separated from the heated diluted slurry, thereby providing the previously described dilution stream and a high solids content heated slurry stream. As indicated, admixing the dilution stream with the solids slurry stream prior to heating thereof lowers the tendency of the solids to agglomerate in the heating zone.

In a specifically preferred embodiment of the present invention there is provided a method for the conversion of solid hydrocarbonaceous solids such as coal to smaller particles wherein the hydrocarbonaceous particles are characterized by their tendency to agglomerate at high temperatures. In this embodiment, a feed slurry of a hydrocarbonaceous material, such as coal, and a fluid, such as water, is diluted with a hereinafter specifically defined recycle stream to provide a diluted feed slurry containing a lesser relative amount of hydrocarbonaceous material than the original feed slurry. This diluted feed slurry is then pressurized and heated to provide a first heated slurry stream. At least a portion of the fluid contained in the first heated slurry stream is then removed to provide the recycle stream. Preferably, this recycle stream is substantially free of hydrocarbonaceous solid particles.

The stream that results after removal of the recycle stream, designated a second heated slurry stream, contains a greater solids content than the first heated slurry stream. The second slurry stream is then exposed to a lower pressure sufficient to cause the fluid to expand and comminute the solids and to provide a mixture of solid particles smaller in average size than contained in the original feed slurry. The dilution of the original slurry stream by the recycle stream lowers the tendency of the particles to agglomerate during the heating step. In addition, since the recycle stream is ultimately admixed with the original slurry stream prior to the heating step, the heat contained within the recycle stream is not lost. In fact, since the recycle stream is ultimately admixed directly with the feed stream, there is very little if any energy lost to the utilization of the recycle stream.

These and other advantages and features of the invention will be further disclosed in the detailed description which follows.

BRIEF DESCRIPTION OF THE DRAWINGS

In the detailed description, reference will be made to the drawing comprised of the following figures:

FIG. 8 is a sectional view of a third alternative embodiment for a three electrode heater in a single container, wherein the electrodes are in vertical alignment, together with the electrical connections thereto;

FIG. 9 is a cross-sectional view of the container shown in FIG. 8 taken on line 9—9 thereof;

FIG. 10 is a graph of the temperature profile of the preferred embodiment of the apparatus shown in FIG. 3;

DESCRIPTION OF THE PREFERRED EMBODIMENT

The present invention provides a method for heating an electrically conductive fluid to temperatures exceeding the critical temperature of the fluid. The present invention is particularly well suited for heating a slurry of a liquid and solid to supercritical conditions. This invention is particularly applicable to heating a slurry of hydrocarbonaceous materials, such as coal, coke, tar sands or coal chars, in a liquid, such as water, methanol, liquefied gases and other liquids which inherently are or can be readily made to be electrically conductive. A preferred slurry includes coal and water.

Figure 1:
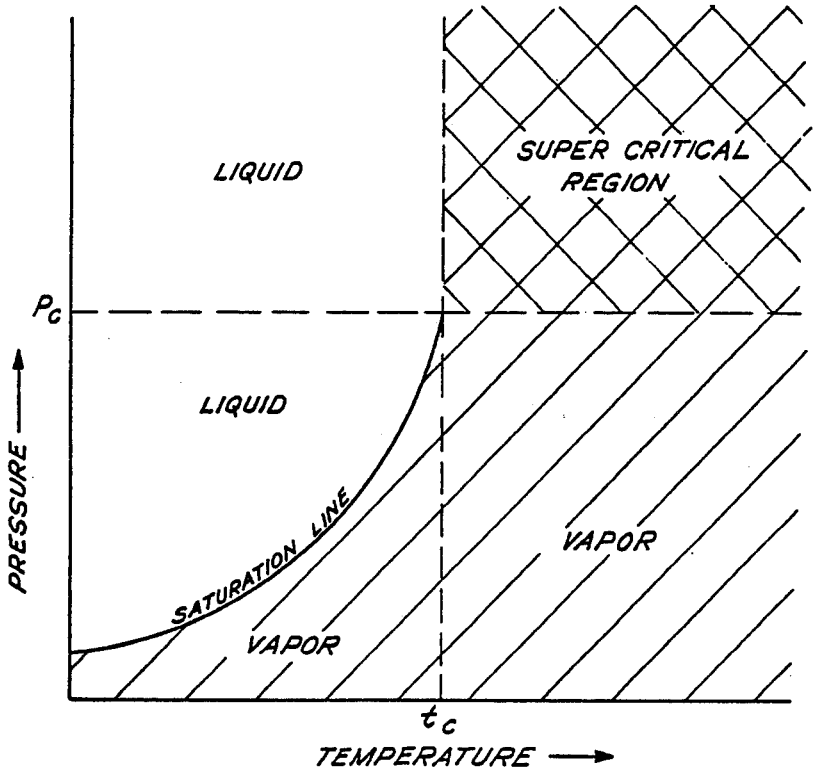
FIG. 1 is a conventional liquid-vapor phase diagram.
Figures 2, 3:
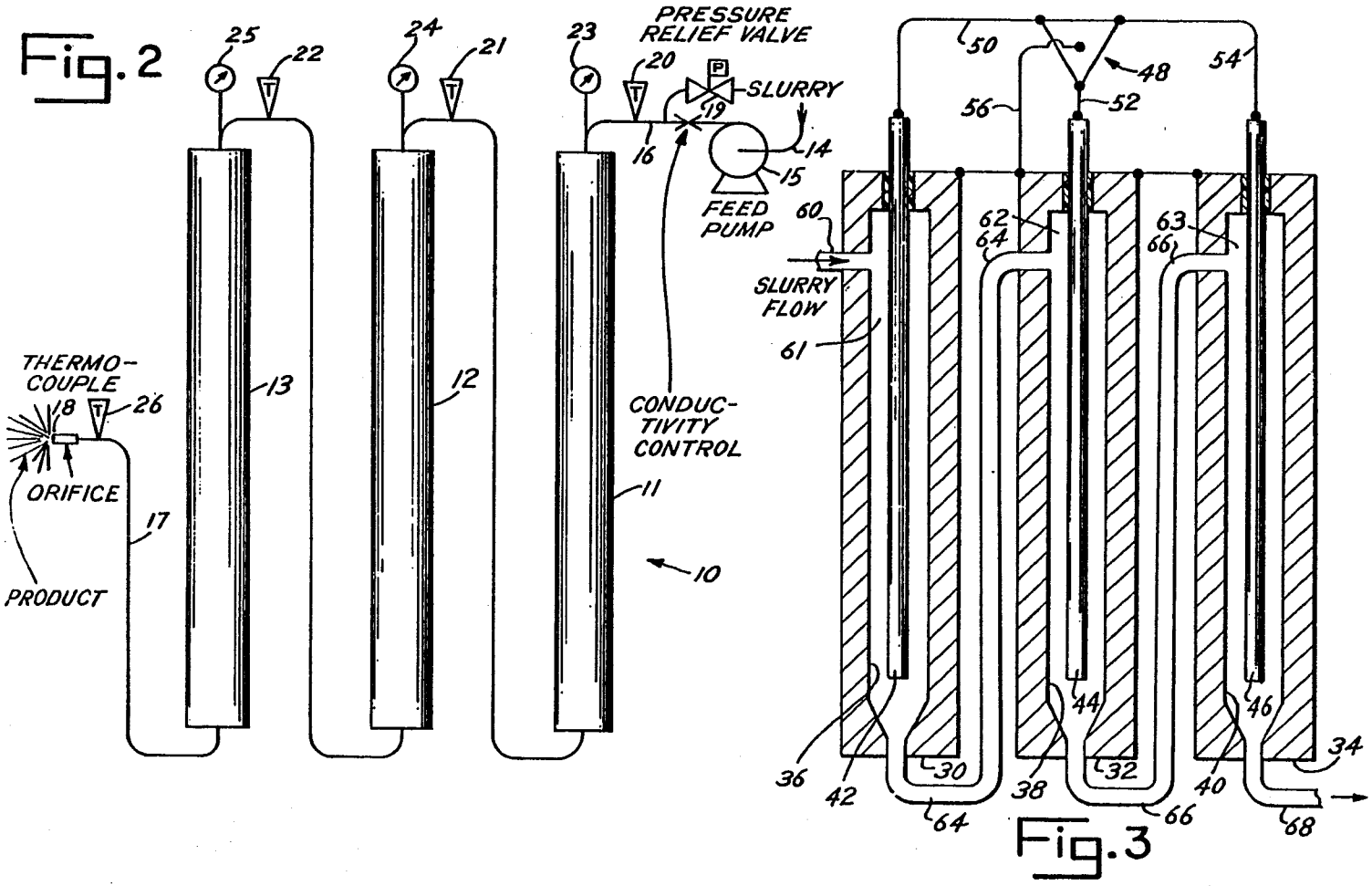
FIG. 2 is a schematic diagram of an apparatus to heat a slurry of a hydrocarbonaceous solid, such as coal, and a fluid, such as water, to supercritical conditions in accordance with a preferred embodiment of the invention.
FIG. 3 is a cross-sectional view of the preferred embodiment of the apparatus illustrated in FIG. 2, showing the mechanical and electrical connections therefor.

Referring to the FIGURES, a preferred embodiment of the preferred apparatus is shown in FIG. 2 as the heating units, 11, 12 and 13, of a system 10 for the explosive comminution of a coal-water slurry. In this system the organic portion of the coal is selectively shattered into micron sized particles through explosive comminution, the sudden creation of strong internal stress forces within the coal. These forces are created by raising the pressure and temperature of the slurry to supercritical conditions and suddenly lowering the pressure, preferably by forcing the supercritical slurry through an adiabatic expansion orifice. The resultant depressurization provides a rapid, explosive expansion of the fluid within the coal and, as a result, explosively shatters the coal particles.

An explosive comminution system is more fully detailed in a U.S. Pat. No. 4,313,737 of Massey et al. entitled "Method for Separating Undesired Components From Coal By An Explosion Type Comminution Process", the teachings of which are incorporated by reference herein.

A coal-water slurry heated in accordance with the present invention, as illustrated in FIG. 2, has a dry solids content of between about 60 and about 10 percent by weight. Higher solids contents in the range of about 40 to 55 percent by weight dry solids are particularly preferred for reasons of economy. High solids contents, however, can lead to fouling of the heating apparatus. By lowering the solids content to about 30% this fouling can be reduced.

In any event, this slurry is passed via line 14 to feed pump 15 which delivers the slurry through line 16 to independent heating units 11, 12 and 13 at a predetermined delivery pressure.

The delivery pressure of the slurry to heating units 11, 12 and 13 is above the critical pressure of the liquid (about 3200 psia for water) but is preferably less than about 16,000 psia. Particularly preferred are pressures within the range of about 4,000–15,000 psia. Higher pressures are most particularly preferred, e.g., 12,000–15,000 psia, since these pressures reduce the tendency for the heat exchange apparatus to foul.

The slurry is sequentially passed from the first heating unit 11, to the second heating unit 12, etc. so that the slurry is heated in a step-wise fashion to a temperature above the critical temperature of the liquid (about 705° F. for water) but preferably below about 1,000° F. For water-coal slurries, particularly preferred temperatures are about 750°–950° F.

The resultant heated, pressurized slurry is then passed through line 17 and is discharged from orifice 18 into a lower pressure environment such as the atmosphere. Orifice 18 provides a substantially instantaneous transition from the high pressure, high temperature conditions within heating units 11, 12 and 13 to the lower pressure environment, typically ambient pressures and temperatures less than about 300° F. The sudden pressure drop causes the supercritical fluid to flash explosively to steam. The rapid expansion of the supercritical fluid selectively comminutes the porous organic portion of the coal into very fine particles while leaving the ash forming mineral material substantially intact.

Since the pressure within the comminution system 10 is relatively high, a pressure release valve 19 to relieve pressures which may exceed the design of the system is provided for safety. The key operating variables within heating units 11, 12, and 13 are measured by thermocouples 20, 21 and 22 and pressure gauges 23, 24 and 25, respectively. The temperature of the slurry delivered to the orifice 18 is measured by thermocouple 26.

It is important to effective comminution that the slurries be heated as rapidly as possible, preferably in about two or three minutes or less. Particularly preferred are heating times of less than 15 seconds at supercritical conditions. Conventional heating techniques are generally too slow and inefficient to accomplish the desired rapid heating under high pressure achieved by this invention.

Rapid heating is desired because long exposure of the coal to water at high temperatures can cause melting and pyrolysis of the hydrocarbon and dissolution of the water soluble ash forming minerals within the coal. Both reactions are undersirable. Partial melting of the hydrocarbon may lead to agglomeration of the coal particles and pyrolysis to partial decomposition of the hydrocarbonaceous material. Dissolution of the ash forming minerals can lead to the presence of ultra fine mineral particles in the shattered product. For example, these mineral particles may be as small as about 0.03 micron, making them difficult, if not impossible, to separate from the valuable hydrocarbonaceous fraction of the shattered coal particles.

Referring to FIG. 3, the heating units schematically designated as 11, 12, and 13, in FIG. 2 are depicted in greater detail as heating units 30, 32 and 34. Each of these units comprise a hollow elongated cylindrical container, preferably formed of an electrically conductive material such as stainless steel and having interior surfaces 36, 38 and 40 capable of conducting a current to a ground wire 56.

Electrodes 42, 44 and 46 extend from the top of the heating units 30, 32 and 34 toward the bottoms thereof. The electrodes are preferably connected by conductors 50, 52 and 54 to a three phase source of alternating current 48 operating at commercially available levels, i.e. about 600 amperes at from about 208 to about 480 volts. Other voltages and/or amperages may also be used.

The slurry or other fluid is initially fed through a conduit 60 into the heating chamber 61 and, sequentially, through pipes 64 and 66 into heating chambers 62 and 63, respectively. As the slurry passes through the heating chamber, an alternating electrical current is passed through the slurry. The electrical resistance of the slurry converts the current into heat energy. The supercritically heated slurry is then passed via pipe 68 to the expansion orifice 18, as previously explained.

FIG. 10 shows the temperature profile of the slurry in the system 10. The heating rate in the first heating unit 30 is approximately 2500 BTU per minute; the heating rate in the second heating unit 32 is approximately 2800 BTU per minute; and the heating rate in the third unit 34 is about 2200 BTU per minute. The temperature of the slurry leaving the system depends not only upon the BTU rate of heating but also upon the slurry flow rate and composition.

As previously explained, a significant advantage of this invention over conventional heating techniques is that heating to supercritical conditions is accomplished more rapidly. An embodiment with three heating units having an electrode $\frac{3}{4}$ inches in diameter and 46 inches in length, each of the three heating units having $2\frac{1}{4}$ inch I.D. and a 60 inch length, provides well over 1,000,000 BTU per hour per square foot of heat transfer over the electrode surface and over 5.4 million BTU per hour per cubic foot of vessel volume. This embodiment can heat about 25 pounds per minute of a coal slurry having about thirty (30) percent dry solids to a temperature of about 800° F. in less than about one minute using a current of 1200 amperes and 240 volts, or a 600 ampere and 480 volts current.

The specific structure for electrically connecting the electrodes in the heating chamber to an external power source is the subject of U.S. Pat. No. 4,286,111, entitled "APPARATUS FOR INTERCONNECTING A POWER SUPPLY TO AN ELECTRODE WITHIN A CHAMBER CONTAINING FLUID MAINTAINED AT A HIGH TEMPERATURE AND PRESSURE", by Massey et al. inventors, the disclosure of which is incorporated by reference herein.

Figures 4, 5, 6, 7:
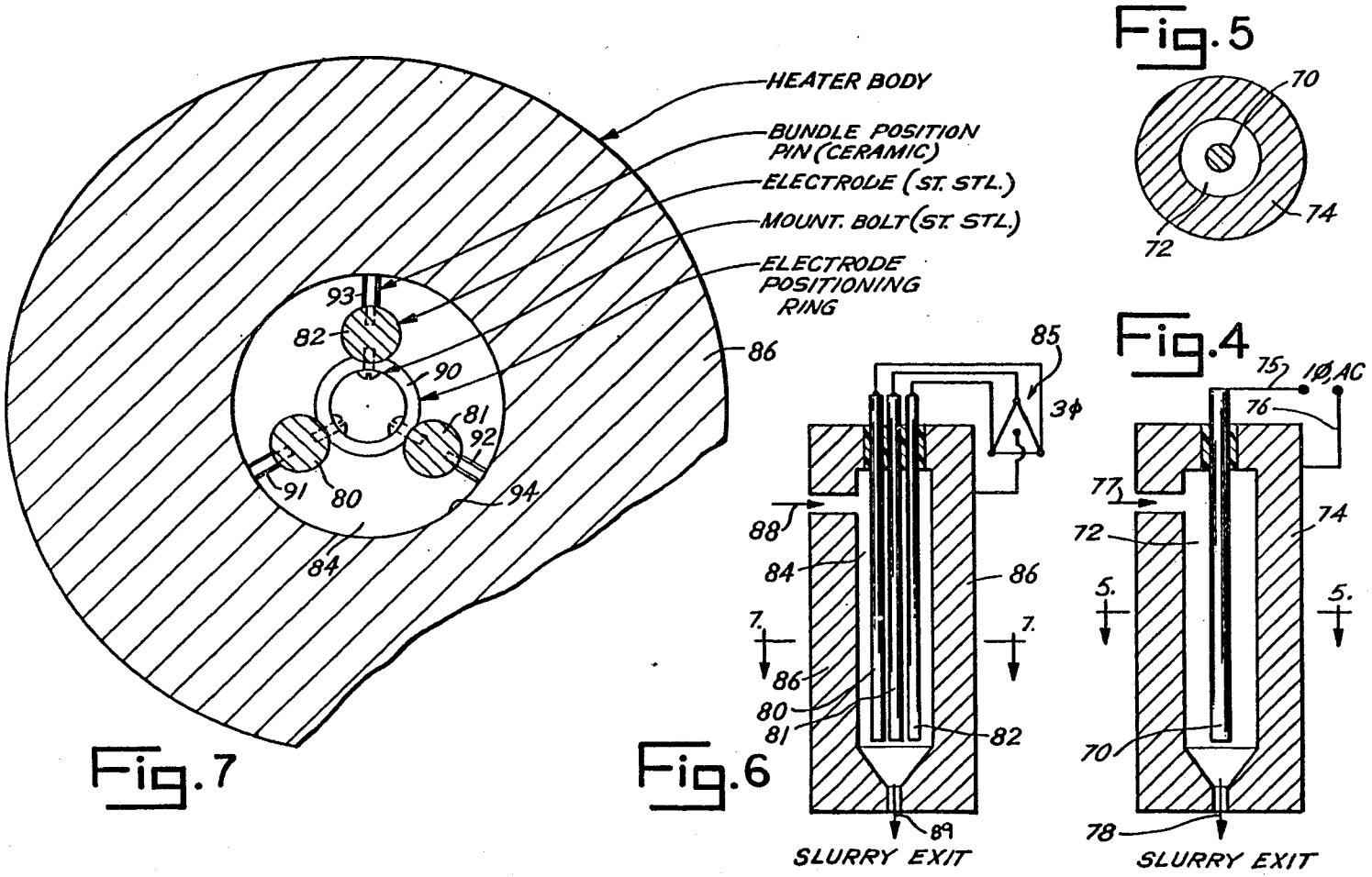
FIG. 4 is a sectional view of an alternative embodiment of the apparatus with the electrical connections thereto.
FIG. 5 is a cross-sectional view taken on line 5—5 of FIG. 4.
FIG. 6 is a sectional view of a second alternative embodiment of the apparatus with the electrical connections thereto.
FIG. 7 is a cross-sectional view of FIG. 6 taken on line 7—7 thereto.

FIGS. 4 and 5 show another embodiment of the apparatus utilizing a single phase electrical power source. In this embodiment current is passed from the power source via conductor 75 to a single electrode 70 positioned within a heating chamber 72 of heating unit 74. Unit 74 is grounded by conductor 76.

Slurry enters the chamber 72 through entrance opening 77 and exits through exit opening 78 after passing through and being heated within heating chamber 72. As shown most clearly in FIG. 5, electrode 70 is preferably, but not necessarily, solid to better accomodate the high pressure within the chamber and the high electrical current levels imposed on the electrode.

FIGS. 6 and 7 show another embodiment wherein three electrodes 80, 81 and 82 are positioned within a single heating chamber 84 defined by housing or unit 86. In this embodiment, a three phase A.C. power is supplied to the electrodes by power source 85. The slurry enters the chamber 84 through inlet 88 and, after being heated, exits through outlet 89. This embodiment is particularly useful where the additional space required for the preferred embodiment shown in FIGS. 2 and 3 is not available.

As shown in FIG. 7, the electrodes 80, 81 and 82 are attached in the heating chamber 84 by stainless steel mounting bolts to a positioning ring 90, preferably manufactured from a ceramic material. Three positioning pins 91, 92 and 93, also formed of ceramic material, are positioned between the electrodes 80, 81 and 82 and the wall 94 so that the electrodes are electrically separated from the chamber wall 94.

Another alternative embodiment, shown in FIGS. 8 and 9, provides three electrodes 100, 101 and 102 vertically aligned within the cylindrical chamber 98 of a single unit 95. The electrical energy for this embodiment is, again, preferably a 240 to 480 volt, three phase alternating current supplied to the electrodes by a power source 103. The electrodes 100, 101, 102 are connected to the source of three phase power 103 through conductors 110, 111, and 112. Container 95 is grounded through a conductor 113. This embodiment can also be employed using upflow of slurry being heated as it passes vertically upward through container 95.

It has been discovered that when a slurry containing a large amount of coal particles in water is heated to high temperatures (e.g., about 600° to about 750° ) the coal particles tend to agglomerate and form an insulating deposit on the electrodes, frequently in the form of a baseball bat. Because of the high electrical resistance of this deposit, the current passing between the electrode and the container and, thus, the rate of heating the slurry is decreased considerably. The severity of this problem varies with both the type of coal being processed and its concentration in the feed slurry.

It has been found that this deposition can be somewhat reduced by operating the process at slightly higher temperatures. For example, the deposition of material on the electrode when using Illinois 6 coal is decreased by increasing the final heating temperature to above 800° F., and for Pittsburgh 8 coal by increasing the temperature to above 750° F.

It has been further discovered that the agglomeration tendency of the coal can be reduced by adding alkaline agents, such as sodium hydroxide, calcium hydroxide or ammonium hydroxide to the coal slurry. Addition of these agents increases the pH of the slurry, causing a reaction between the hydroxide ion and low melting substances in the coal at the coal's surface.

Another aspect of this invention involves the addition of the electrolyte to the slurry to provide a simple and efficient control of the slurry heating through regulation of the slurry's electrical resistance. The rate of electrolyte addition is simply increased or decreased for a given slurry feed rate in order to regulate the rate of heating without the use of complex and expensive electrical control mechanisms.

Design of the heating unit is very important when using electrolyte addition to control the rate of heating. In FIG. 3, the distance between the electrodes 42, 44, 46 and the cylinder 30, 32, 34 must be greater than the distance which produces the desired level of electrical resistance of the untreated slurry. It thus becomes necessary to add electrolyte to the slurry in order to reach the desired conductivity and heating rate. The rate of heating can thereafter be raised or lowered by increasing or decreasing the concentration of electrolyte in the slurry. In the design of actual embodiments of the apparatus, the resistance of slurry filled units is a complex function of relative vessel and electrode diameter.

In contrast to previous devices, such as the de Lorenzi, all embodiments preferably operate with a full system wherein the fluid completely surrounds the conductor. The rate of heating is preferably controlled by varying the conductivity of fluid rather than the level of fluid in the container.

The electrolyte which may be added to the liquid or slurry includes acids, water soluble hydroxides, such as alkalai metal or alkaline earth hydroxides, or water soluble halogen salts. Other compounds capable of functioning as an electrolyte may also be utilized. Specific examples of the compounds which may be used as electrolytes are Nacl, $HNO_3$, HCl, NaOH, $Ca(OH)_2$, $KMnO_4$ or $NH_4OH$. Particularly preferred is NaOH.

Figure 11:
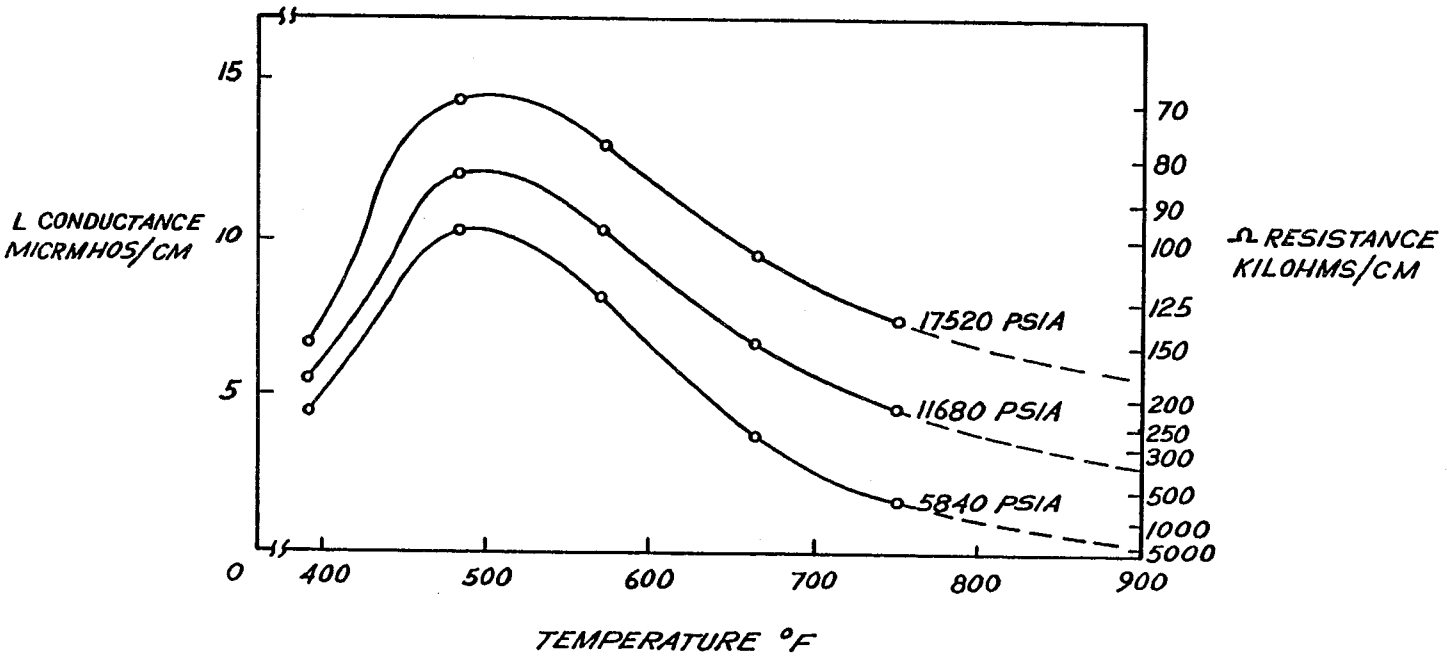
FIG. 11 is a graph showing the specific conductance (L) and resistance (R) versus temperature of water at specific pressures as illustrated in *High Pressure Physics and Chemistry,* by R. S. Bradley, Academic Press, 1963.

Proper balancing of the three phase electrical current within the preferred heating unit shown in FIG. 3 is also effected by the individual distances between the electrodes 42, 44, 46 and the cylinders 30, 32, 34. For example, the graph shown in FIG. 11 illustrates the variation of specific conductance (L) specific and resistance (R) for pure water with water temperature at specific pressures. Variation in specific conductance and specific resistivity with temperature requires that the electrode sizing in each of the three units be determined separately to achieve suitable power balance among the three phases. The resistance in each unit should be substantially the same as the resistance in each of the other units so that each unit will consume power at substantially equal rates. In FIGS. 6 and 7 phase balance is automatic and exact.

An important advantage of this invention lies in the fact that it does not involve an indirect transfer of heat and this avoids the energy loss associated with indirect heat transfer. Heat is created in situ in the slurry through dissipation of electrical energy by the resistance of the slurry. The efficiency of this system in heating liquids or slurries is on the order of about 95 to about 99 percent of electrical input.

Equally important, there is substantially no high temperature heating surface, such as in a shell and tube heat exchanger, to which agglomerating solids may stick. The generation of heat in situ minimizes agglomeration of the solid.

Figure 12:
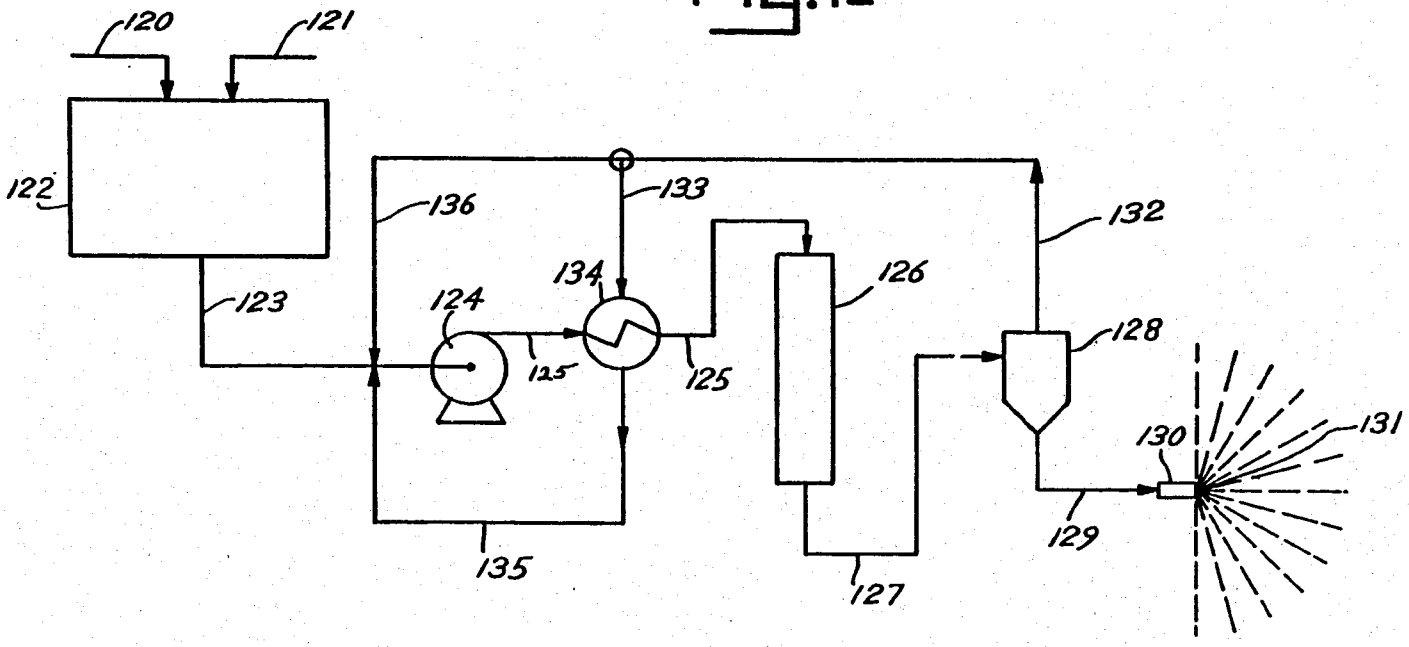
FIG. 12 is a schematic flow diagram of a preferred embodiment of practicing the present invention.

Referring to FIG. 12, there is schematically illustrated a particularly preferred embodiment of the present invention for the comminution of coal slurry containing a large percentage of coal in the slurry. In particular, this embodiment is well suited for use in coal comminution processes employing a heating step wherein the heating of the slurry is adversely affected by a high coal concentration in the slurry being heated. In this embodiment, coarsely pulverized coal particles and water entering via lines 120 and 121, respectively, are admixed in mixing storage zone 122 to provide a coal-water slurry capable of being removed therefrom. Depending on the particle size of the coal, the slurry can contain about 20–60% by weight of dry coal. Preferred are slurries containing about 45–55% by weight of dry coal.

The concentrated coal slurry formed in mixing-storage zone 122 is withdrawn from zone 122 via line 123 and passed to pump 124 which pressurizes the slurry to the desired supercritical pressure. Prior to pressurizing the slurry, however, the solids content of the slurry is lowered to a solids content of about 20–45% preferably 30 to 40%, by weight by admixing water from a recycle stream which is preferably substantially free of appreciable amounts of coal, i.e. less than about 10% by weight coal, with the high coal content slurry. The dilution water is obtained, in a manner to be described in detail later, from the effluent from the heating chamber 126 and is passed via line 132 for mixing with the high coal content slurry passing through line 123.

The dilution of the slurry is designed to provide a reduced coal content in the slurry while the slurry is being heated using the method and apparatus of this invention. The studies leading to the present discovery have shown that lowering the solids content in the slurry reduces fouling of the electrode.

Returning to FIG. 12, the diluted slurry is pressurized by pump 124 and passed via line 125 to heating chamber 126 wherein the diluted slurry is heated as previously described in connection with this invention. The effluent from heating chamber 126 is removed via line 127 and passed to separation zone 128 wherein sufficient water is removed from the diluted slurry to provide a first stream containing supercritical water substantially free from coal particles and a second stream of supercritically heated high coal content slurry having a solids content substantially equivalent to the coal content of the slurry removed from mixing-storage zone 122. Separation zone 128 is preferably a cyclone or hydrocyclone designed to separate the more dense coal particles from the less dense fluid.

The supercritically heated, high coal content slurry, preferably having a weight percent coal content of about 60–75%, is removed from separation zone 128 via 129 and passed to adiabatic expansion orifice 130 for discharge to a lower pressure environment 131, as described in connection with FIGS. 1–10, to thereby convert the coal particles by explosive expansion to a smaller size.

The supercritically heated water stream is removed from separation zone 128 via line 132 and admixed, as described, with the high coal content slurry being passed to pump 124. The admixing of water in line 132 to dilute the slurry stream in line 123 can be accomplished in either of at least two ways to maximize the benefit of pre-heating the stream 123 before it enters the heating chamber 126. First, water in line 132 may be admixed directly with the high coal content slurry in line 123 via line 136 as previously suggested. Second, and more preferably, the water in line 132 may be passed via line 133 to heat exchange zone 134 wherein heat contained in the water is transferred to the high pressure slurry emanating from pump 124, thereby cooling the water in line 133 which is then passed via line 135, admixed with line 123 and passed to pump 124. This method of heat exchange avoids raising the temperature of the slurry passed to pump 124 thereby increasing the effective life and efficiency of the pumping system, i.e. the pump system is not subjected to excessively high temperatures.

The process flow schematically illustrated in FIG. 12 has several advantages over a once through, high coal content system. For example, although a high coal content stream is passed to expansion orifice 130, thereby avoiding undue dilution of the resultant product, the key upstream apparatus, the pumping system and the heating system, handle coal slurries significantly less concentrated. This extends the useful life of both the pumping system and the heating system and provides more efficient energy utilization in the heating system. In addition, the heat transferred to the liquid used to dilute the slurry is not lost because all of this liquid and its heat content is ultimately recovered through recycle. In effect, the dilution liquid and its associated heat energy form a closed loop around the pumping and heating units.

From the foregoing, it is apparent that there is provided an improved method and apparatus for raising the temperature of a fluid to very high temperatures and pressures and, more specifically, to above critical pressures and temperatures. The above description relates to a preferred embodiment of the invention. The preferred configuration is described and illustrated in the drawing. Alternative configurations are, however, possible within the scope of the invention. Electronic controls to vary and control the temperature may be provided. Different shapes may be found for the containers and the electrodes. Therefore, the subject matter of the invention is to be limited only by the following claims and their equivalents.

What is claimed is:

1. A method for conversion of hydrocarbonaceous solid particles to smaller particles, said hydrocarbonaceous particles characterized by the tendency to agglomerate at high temperatures, the method comprising the following steps:

mixing the hydrocarbonaceous particles with a fluid to provide a feed slurry;

diluting the feed slurry with a relatively cooled recycle stream to provide a diluted slurry, the recycle stream comprising a fluid containing a lesser amount of hydrocarbonaceous particles than either the feed slurry or the diluted slurry;

heating and pressurizing the diluted slurry to conditions sufficient to provide a first, superheated slurry stream;

separating the superheated slurry stream into first and second stream portions, said first stream portion defining said recycle stream, said second stream portion defining a concentrated and heated slurry stream;

exposing the concentrated and heated slurry stream to a lower pressure sufficient to cause the fluid thereof to expand and comminute the hydrocarbonaceous particles thereof to a smaller size;

passing said recycle stream through means for lowering the temperature of the recycle stream to thereby define said relatively cooled recycle stream agglomerate during heating thereof.

2. A method of claim 1 wherein said hydrocarbonaceous solid particles are coal particles and said fluid is water.

3. A method of claim 2 wherein said diluted slurry stream is heated by an electric current from an electrode through the diluted slurry stream, said recycle stream lowering the tendency of the coal particles to deposit on said electrode.

4. A method as in claim 3 wherein said diluted slurry stream is heated and pressurized to supercritical conditions to provide the first heated slurry stream as a supercritical slurry stream.

5. A method of claim 1 wherein the diluted slurry stream is pressurized before being heated in said heating and pressurizing step.

6. A method as in claim 5 wherein said means for lowering the temperature of the recycle stream comprises a heat exchanger which transfers heat from said recycle stream to said diluted slurry, thereby conserving and reusing the latent energy represented by heating the fluid of the recycle stream while also minimizing the tendency of the hydrocarbonaceous solid particles to agglomerate upon heating.

7. A method for heating a feed stream of a slurry of a liquid and solids, the solids having a tendency to agglomerate upon exposure to elevated temperatures, the method being to reduce agglomeration and comprising, in sequential order, the following steps:

providing a feed stream;

joining in admixture the feed stream with a dilution stream to create an admixture stream being diluted of solids relative to the feed stream;

heating said admixture stream to an elevated temperature to create a superheated effluent stream;

separating a portion of said superheated effluent stream into, said dilution stream, and a heated and concentrated output stream of solids relative to the admixture stream;

passing said dilution stream through temperature lowering means to thereby provide a relatively cooled dilution stream prior to the step of joining said dilution stream in admixture with the feed stream;

whereby the admixture of the feed stream with the relatively cooled dilution stream before heating lowers the tendency of the solids to agglomerate in the heating zone, and whereby there is provided a heated, concentrated slurry of said solids.

* * * * *